US007255199B2

(12) United States Patent
Ishiwata

(10) Patent No.: US 7,255,199 B2
(45) Date of Patent: Aug. 14, 2007

(54) CIRCULATING TYPE FOOD AND DRINK TRANSPORT APPARATUS

(75) Inventor: Takeshi Ishiwata, Machida (JP)

(73) Assignee: Audio-Technica Corporation, Tokyo (JP)

( * ) Notice: Subject to any disclaimer, the term of this patent is extended or adjusted under 35 U.S.C. 154(b) by 68 days.

(21) Appl. No.: 11/150,241

(22) Filed: Jun. 13, 2005

(65) Prior Publication Data

US 2006/0289238 A1 Dec. 28, 2006

(51) Int. Cl.
*E04H 3/04* (2006.01)

(52) U.S. Cl. ..... 186/49; 186/38; 186/42

(58) Field of Classification Search ..... 209/509, 209/522, 523, 524, 559, 583; 700/213–215, 700/225, 226; 198/349.5–9, 349.95; 186/38, 186/39, 42, 49

See application file for complete search history.

(56) References Cited

U.S. PATENT DOCUMENTS 6,431,318 B1 8/2002 Tanaka
6,554,106 B1 * 4/2003 Tokimoto ..... 186/49
6,581,727 B1 * 6/2003 Tokuno ..... 186/50
7,099,433 B2 * 8/2006 Sommer et al. ..... 378/53
2006/0011417 A1 * 1/2006 Chen et al. ..... 186/39

* cited by examiner

*Primary Examiner*—Patrick Mackey
*Assistant Examiner*—Mark J. Beauchaine
(74) *Attorney, Agent, or Firm*—Birch, Stewart, Kolasch & Birch, LLP

(57) ABSTRACT management device for managing the expiration date of food and drink arranged on a plate and including a camera for capturing a two-dimensional code on a cylindrical base of the plate, a barcode scanner for analyzing the two-dimensional code captured by the camera and extracting a plate number, a management main body for receiving the plate number output from the barcode scanner and collectively managing the traveling plates, and a DIO (Digital Input/Output) module. The DIO module is connected to a detection switch disposed on a downstream position of the camera and a discharge mechanism disposed on a downstream side of the detection switch to perform a bidirectional communication with the management main body. A separation distance between the camera and the detection switch is shorter than a diameter of the plate.

1 Claim, 9 Drawing Sheets discharge table (TBL2)

| plate number CL5 | charged time CL6 | discharged process time CL7 | elapsed time CL8 | status CL9 |
|---|---|---|---|---|
| XXXX | HH:MM | HH:MM | HH:MM | 1 |
| ▪ | ▪ | ▪ | ▪ | 3 |
| ▪ | ▪ | ▪ | ▪ | ▪ |
| ▪ | ▪ | ▪ | ▪ | ▪ |
| ▪ | ▪ | ▪ | ▪ | ▪ |
| | | | | |
| | | | | |
| | | | | |
| | | | | |

FIG.8A travel management table (TBL1)

| | plate number CL1 | charged time CL2 | discrimination time CL3 | elapsed time CL4 |
|---|---|---|---|---|
| 1 | XXXX | HH:MM | HH:MM | HH:MM |
| 2 | ▪ | ▪ | ▪ | ▪ |
| 3 | ▪ | ▪ | ▪ | ▪ |
| 4 | ▪ | ▪ | ▪ | ▪ |
| 5 | ▪ | ▪ | ▪ | ▪ |
| ▪ | ▪ | ▪ | ▪ | ▪ |
| ▪ | ▪ | ▪ | ▪ | ▪ |
| ▪ | ▪ | ▪ | ▪ | ▪ |
| ▪ | ▪ | ▪ | ▪ | ▪ |
| ▪ | | | | |
| ▪ | | | | |
| ▪ | | | | |
| ▪ | | | | |
| MAX | | | | |

MAX=700

FIG.8B discharge table (TBL2)

| plate number CL5 | charged time CL6 | discharged process time CL7 | elapsed time CL8 | status CL9 |
|---|---|---|---|---|
| XXXX | HH:MM | HH:MM | HH:MM | 1 |
| ▪ | ▪ | ▪ | ▪ | 3 |
| ▪ | ▪ | ▪ | ▪ | ▪ |
| ▪ | ▪ | ▪ | ▪ | ▪ |
| ▪ | ▪ | ▪ | ▪ | ▪ |
| | | | | |
| | | | | |
| | | | | |
| | | | | |

FIG. 9A PLANE FIGURE
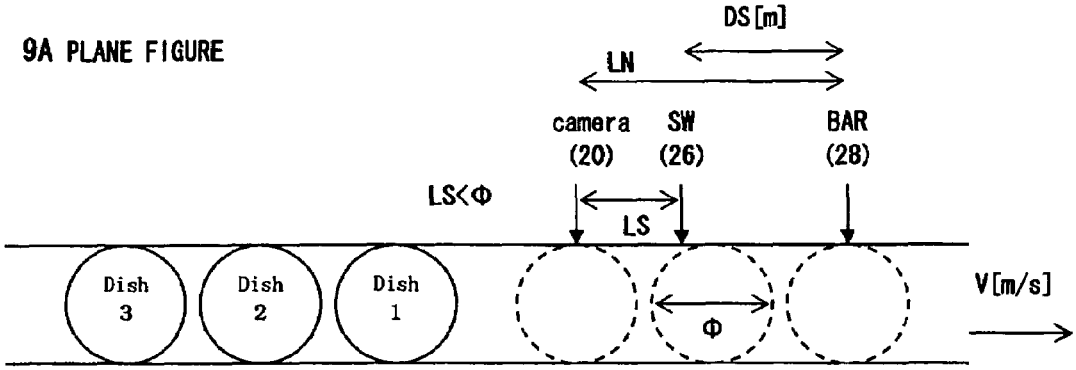
FIG. 9B TIME CHART
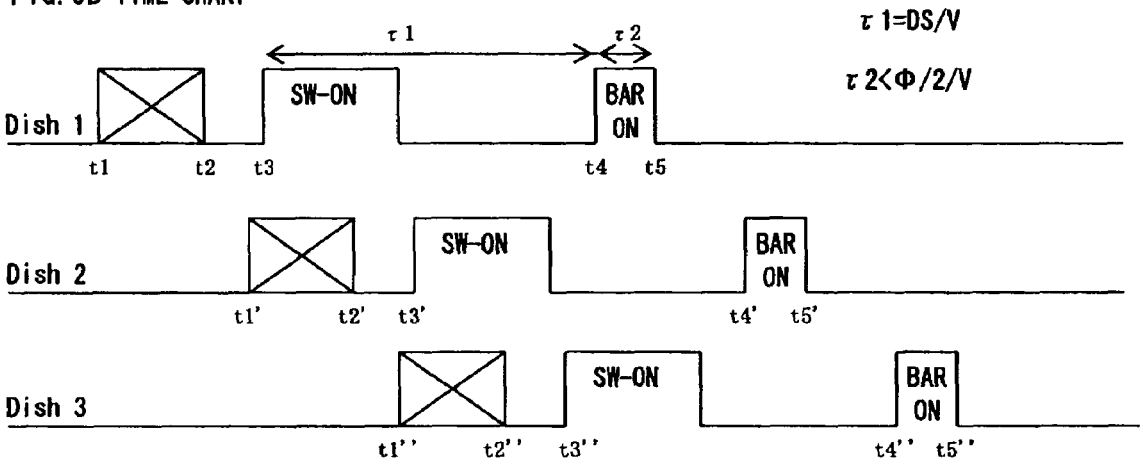
FIG. 9C
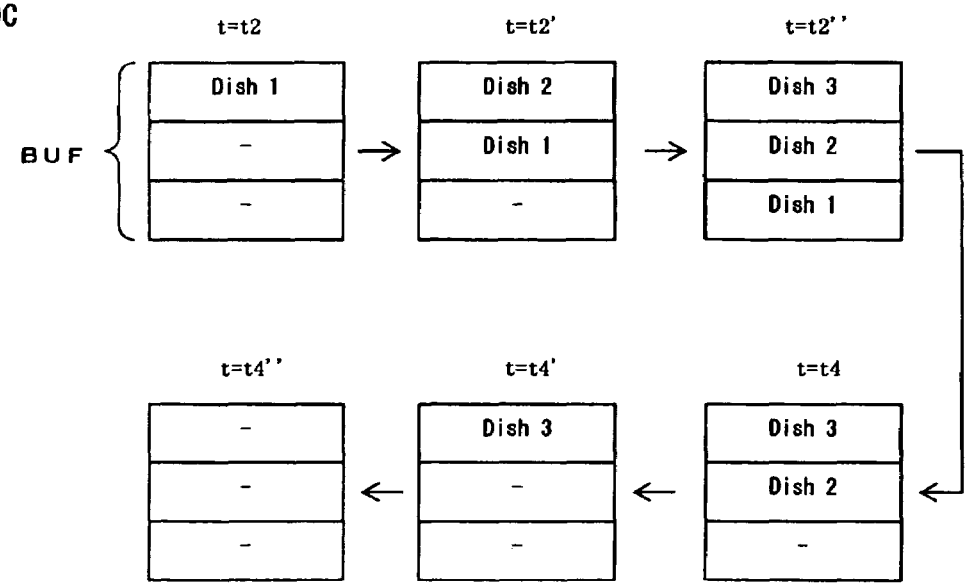

CIRCULATING TYPE FOOD AND DRINK TRANSPORT APPARATUS

BACKGROUND OF THE INVENTION

1. Field of the Invention

The present invention relates to a circulating type transport apparatus capable of easily managing the distribution time and the expiration date of food and drink traveling on an endless chain.

2. Description of the Prior Art

An apparatus disclosed in, for example, U.S. Pat. No. 6,554,106 is known for an apparatus that uses a two-dimensional code to manage the expiration date of food and drink traveling on an endless chain. The invention for controlling a suitable supply amount of plates with food and drink arranged thereon is disclosed in U.S. Pat. No. 6,431,318.

However, in the apparatus of U.S. Pat. No. 6,554,106, a container dedicated to conveying the plate is required in addition to the plate on which food and drink is arranged; thus, the apparatus lacks simplicity. Further, the entire apparatus must be modified, and thus cannot be adapted to an existing apparatus. U.S. Pat. No. 6,431,318 also lacks simplicity.

The present invention, in view of the above, aims to provide an inexpensive and simple circulating type transport apparatus that reliably discharges the plate with outdated food and drink and that saves discharged history on a computer. Further, the present invention aims to provide a circulating type transport apparatus capable of adding a function of managing the expiration date without changing the drive mechanism of the existing facility.

SUMMARY OF THE INVENTION

In order to achieve the above aim, the present invention proposes a circulating type transport apparatus comprising: an endless chain slidably moving on a circulating type transport path; a drive section for circulating the endless chain; and a management device for managing an expiration date of food and drink arranged on a plate traveling on the endless chain, the management device including: a camera for capturing a two-dimensional code on a cylindrical base of the plate; a barcode scanner for analyzing the two-dimensional code captured by the camera and extracting a plate number; a management main body for receiving the plate number output from the barcode scanner and collectively managing the traveling plates; and a DIO module, connected to a detection switch disposed on a downstream position of the camera and a discharge mechanism disposed on a downstream side of the detection switch, for performing a bidirectional communication with the management main body, a separation distance between the camera and the detection switch being set to be shorter than a diameter Φ of the plate, and the DIO module having: notification means for transmitting a detection signal received from the detection switch to the management main body with its terminal number; and discharge means for operating the discharge mechanism based on a control signal received from the management main body.

The timing the barcode scanner extracts the plate number from the two-dimensional code of the cylindrical base always changes. That is, the plate number may be extracted from the two-dimensional code positioned near the front end TOP of the cylindrical base or the plate number may be extracted from the two-dimensional code positioned near the back end ED of the cylindrical base. Therefore, the elapsed time from the moment the two-dimensional code is extracted until the discharge mechanism is operated is not constant. However, in the present invention, since the detection switch is provided at the immediate downstream of the camera, by operating the discharge mechanism after a predetermined time $\tau 1$ from when the detection switch recognizes the plate, the unnecessary plate can be reliably discharged. Further, as the relationship $LS<\Phi$ satisfies, the plate to be discharged can be reliably specified.

Preferably, the management main body is provided with: a travel management table TBL1 for managing an elapsed time from the start of travel for all the plates traveling on the circulating type transport path in relation to the plate number; a discharge table TBL2 for managing the discharge process time for the plates which elapsed time has exceeded a predetermined value in relation to the plate number; a discharge flag FG for temporarily storing the fact that the plate which elapsed time has exceeded the predetermined value is detected; and a timer TMR for timing the time from when receiving the detection signal from the DIO module until operating the discharge mechanism.

BRIEF DESCRIPTION OF THE DRAWINGS

FIG. 8A is a view explaining a travel management table;

FIG. 8B is a view explaining a discharge table;

FIG. 9A is a planar view showing a positional relationship between a camera, a photoelectric switch, and a discharge rod;

FIG. 9B is a timing chart showing the operation of the camera, the photoelectric switch, and the discharge rod;

FIG. 9C is a view showing the transition of a discharge buffer; and

DETAILED DESCRIPTION OF THE INVENTION

Figure 1:
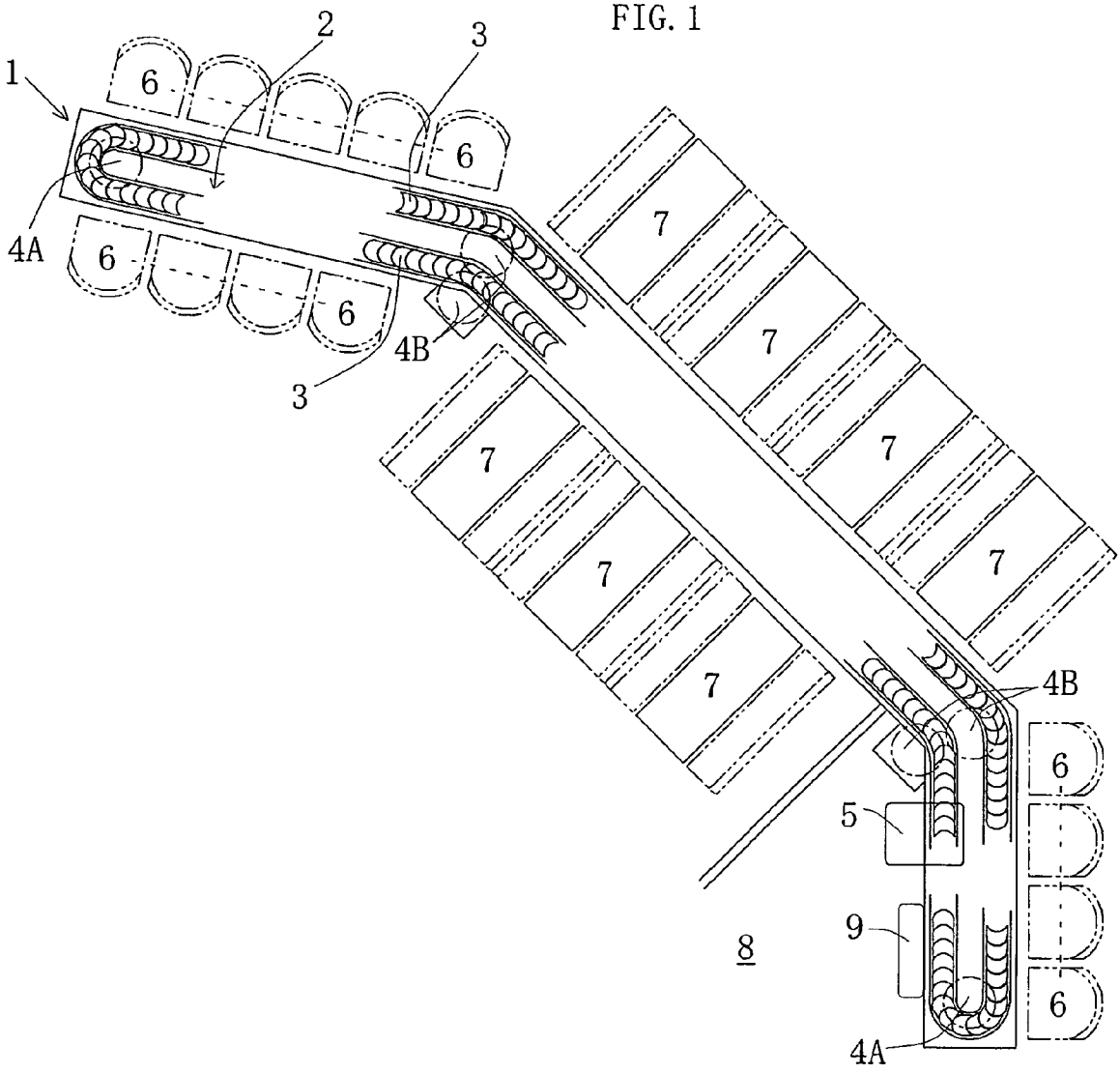
FIG. 1 is a planar layout view showing one example of a circulating type transport apparatus.

FIG. 1 is a planar layout view showing a schematic configuration of a circulating type transport apparatus 1 of the preferred embodiment. The circulating type transport apparatus 1 mainly includes an endless chain 3 that slides and circulates on a circulating type transport path 2, a drive section 4 for circulating the endless chain 3, and a management device 5 for managing the distribution time and the expiration date of food and drink traveling on the endless chain 3.

As shown in the figure, counters 6 and tables 7 are provided around the circulating type transport path 2, and the customers are allowed to take a seat of their choice. A kitchen 8 where the attendants work is provided on the right side of FIG. 1, and the management device 5 is disposed in the kitchen 8. A charging work section 9 for charging or placing the plate with food and drink on the endless chain 3 is disposed on the upstream side of the management device 5.

Figure 2A:
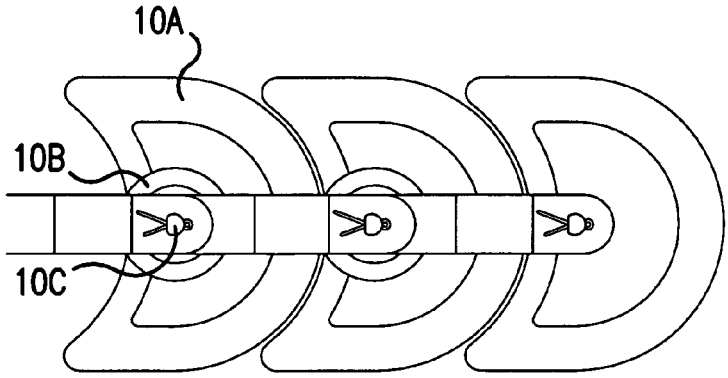
FIGS. 2A and 2B are views showing a configuration of an endless chain.
Figure 2B:
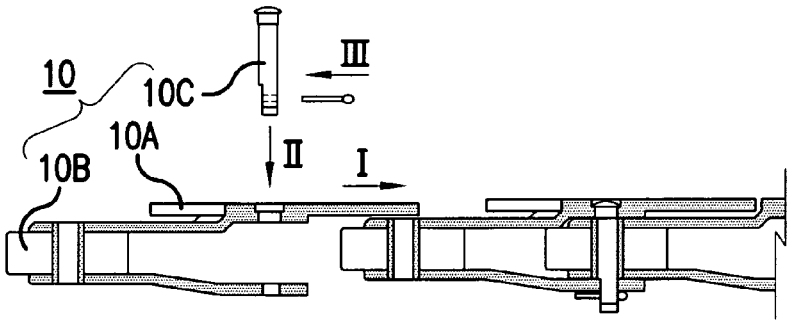

As shown in FIGS. 2A and 2B, the endless chain 3 is formed by successively connecting a chain until 10 comprising a crescent plate 10A and a rotatable roller 10B with a connecting pin 10C. The plate 12 with food and drink 11, such as, sushi, is placed on the crescent plate 10A, so that the food and drink 11 continuously travels before the customers with the circulation of the endless chain 3.

The drive section 4 comprises driving sprockets 4A disposed on the terminal ends of the transport path 2, and driven sprockets 4B disposed on bent parts of the transport path 2. The driving sprockets 4A and the driven sprockets 4B continuously circulate the endless chain 3 by meshing with the rotatable roller 10B of the endless chain 3 (FIG. 1).

Figure 3:
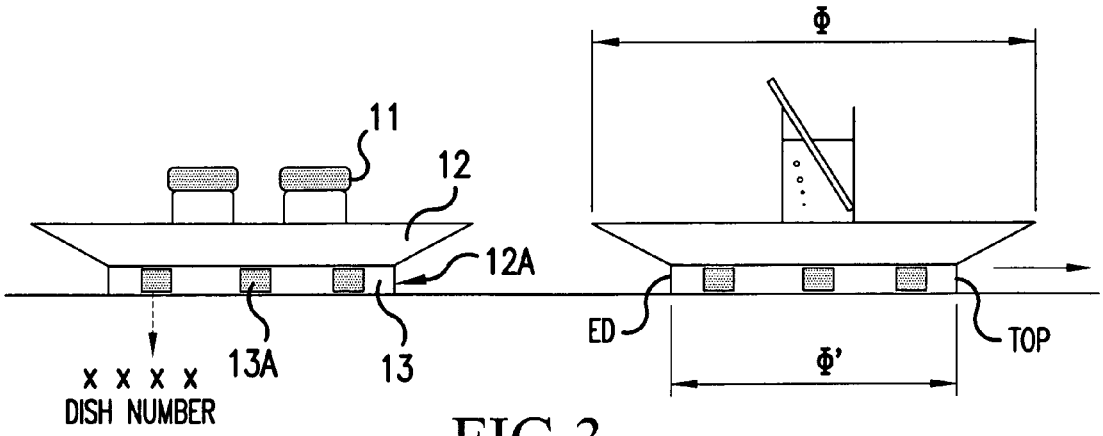
FIG. 3 is a view showing a positional relationship between the plate and the two-dimensional code.

As shown in FIG. 3, a two-dimensional code seal 13 is applied to all the plates 12 used in the circulating type transport apparatus 1 at the outer periphery of the cylindrical base 12A, which forms the bottom part of the plate 12. In the two-dimensional code seal 13, the same two-dimensional codes 13A are repeatedly applied with a predetermined spacing. The two-dimensional code 13A is merely an unrecognizable pattern for humans, but represents a four digit number sequence (plate number) that is recognizable by computers in a two dimensional pattern.

When charging the plate of such configuration onto the transport path 2, the food and drink 11 is obviously arranged on the plate. In the following description, "the plate with food and drink arranged thereon" is expressed simply as "plate".

In the circulating type transport apparatus 1, the total time in which each plate 12 travels on the circulating type transport path 2 is managed in relation to the plate number read from each plate. Therefore, the plate 12 which total traveling time has exceeded a predetermined time that represents the expiration date can be automatically discharged.

Figure 4:
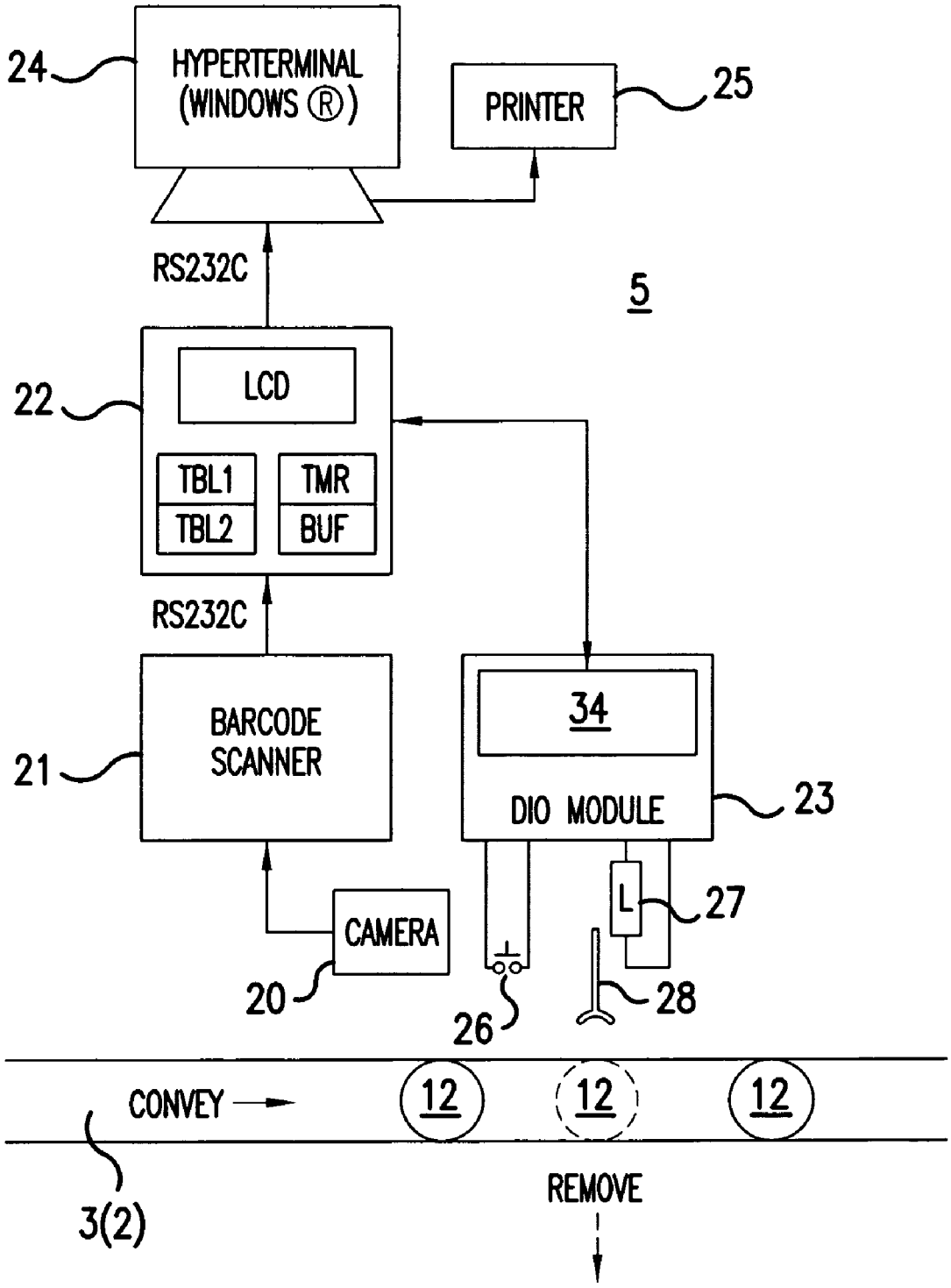
FIG. 4 is a block diagram showing a configuration of a management device.

FIG. 4 is a block diagram showing a specific configuration of the management device 5 disposed on the downstream side of the charging work section 9. The management device 5 mainly includes a camera 20 for capturing the two-dimensional code 13A on the cylindrical base 12A of the plate, a barcode scanner 21 for decoding the two-dimensional code 13A captured by the camera 20 and extracting the four digit plate number, a management main body 22 for receiving the plate number output from the barcode scanner 21 and collectively managing the traveling plates, a DIO (Digital Input/Output) module 23 connected to the management main body 22, and a personal computer 24, connected to the management main body 22, for acquiring the management information.

The personal computer 24 operates with Windows (registered trademark) OS and is connected to a printer 25. It is to be noted that the personal computer 24 is normally in a non-operating state, and operates only when necessary. The personal computer 24 and the management main body 22, and the management main body 22 and the barcode scanner 21 are connected with a serial line of RS232C standard. Further, the management main body 22 and the DIO module 23 are also connected with the serial line.

The management main body 22 is a computer device comprising a liquid crystal display LCD. The liquid crystal display LCD displays the state of the plate passing before the camera 20. More specifically, with regards to the plate passing before the camera 20, the elapsed time from the start of travel, the remaining time allowed for traveling and the like are displayed along with the plate number of the relevant plate.

In order to realize such managing operation, a travel management table TBL1 and a discharge table TBL2 are provided in the management main body 22. A plurality of timers TMR of hardware configuration are built in to discharge the outdated food and drink from the transport path 2 (see FIG. 7B).

FIG. 8A shows the travel management table TBL1 provided in the memory of the management main body 22. The travel management table TBL1 includes four storage columns CL1 to CL4, more specifically, a plate number column CL1, a charged time column CL2, a discrimination time column CL3, and an elapsed time column CL4. The four digit plate number acquired from the plate traveling on the transport path 2 is stored in the plate number column CL1, and the time the plate number is first detected is stored in the charged time column CL2. In the discrimination time column CL3, the discrimination time is updated each time the plate number is extracted. Further, the elapsed time from the charged time until the discrimination time is stored in the elapsed time column CL4.

The management information including the above four types of data are newly stored in the travel management table TBL1 each time a new plate number is detected. When, on the other hand, the plate with outdated food and drink arranged thereon is discharged from the transport path 2, the management information of such discharged plate is deleted from the travel management table TBL1. Therefore, the number of management information stored in the travel management table TBL1 indicates the total number of plates traveling on the transport path 2 at the time.

Focusing on such aspect, in the present invention, the management information storable in the travel management table TBL1 has an upper limit to suppress the total number of plates charged and traveling on the transport path 2 to a suitable value. This upper limit is naturally determined from the relationship between the entire length of the transport path 2 and the size of the plate. The plate may be charged to the transport path 2 until the upper limit is reached, but after the upper limit has been reached, such fact is displayed on the liquid crystal display LCD thereby prohibiting any further plates to be charged. If the plate is erroneously charged thus exceeding the upper limit, the relevant plate is forcibly discharged from the transport path 2. Therefore, according to the circulating type transport apparatus 1, new plates will not be charged as much as to flow out from the transport path 2. Thus, a suitable number of plates are always traveling.

FIG. 8B shows the discharge table TBL2 provided in the memory of the management main body 22. The discharge table TBL2 includes five storage columns CL5 to CL9, i.e., a plate number column CL5, a charged time column CL6, a discharged process time column CL7, an elapsed time column CL8, and a status column CL9. The data of the plate number column CL5 and the charged time column CL6 are memory transferred from the corresponding columns of the travel management table TBL1. The time each time the outdated plate is discharged is stored in the discharged time column CL7, and the elapsed time from the charged time until the discharged time is stored in the elapsed time column CL8. In the status column CL9, the cause of discharge is specified and stored. The cause of discharge may be discharge due to past of expiration date, and discharge due to overflow of the travel management table TBL1.

A touch panel is provided on the liquid crystal display LCD of the management main body 22. When the attendant pushes an appropriate part of the touch panel, the management information indicating the history such as, the traveling time etc. of each plate are output towards the personal computer 24 in data of CSV (Comma Separated Values) format. Therefore, according to the apparatus of the present invention, with a simple configuration, the management information of the plate is saved in the memory device of the personal computer 24 and is further output to the printer 25 for printing at any time.

The barcode scanner 21 is a computer device for analyzing the image data continuously transmitted from the camera 20, and extracting the two-dimensional code. In particular, the barcode scanner 21 is set so as to continuously analyze the image data continuously transmitted from the camera 20. Further, the barcode scanner 21 is set so that when the two-dimensional code 13A is detected from the image data, the code is analyzed and the four digit plate number is extracted, and the extracted result is immediately output to the management main body 22. It is to be noted that since the two-dimensional code appears on the curved cylindrical base 12A, the timing (that is, timing the management main body 22 receives the plate number) for extracting the plate number is not constant. That is, the two-dimensional code positioned near the front end TOP may be extracted, or only the two-dimensional code positioned near the back end ED may be extracted (see FIG. 3).

The barcode scanner 21 sometimes extracts the same plate number continuously, but in such case, it is set so as to discard the relevant plate number. Therefore, even if the same two-dimensional code is repeatedly extracted from one cylindrical base 12A, the barcode scanner 21 does not redundantly transmit the same plate number to the management main body 22.

The DIO module 23 sequentially detects the plate 12 traveling on the transport path 2, and transmits the plate detected signal to the management main body 22. The plate detecting process by the DIO module 23 is necessary in addition to the extracting process of the plate number by the barcode scanner 21 because the position of the plate cannot be accurately specified with the barcode scanner 21. The DIO module 23, based on the command from the management main body 22, reciprocates a substantially T-shaped discharge rod 28 to remove the outdated food and drink from the transport path 2 along with the plate 12. The reciprocating movement of the discharge rod 28 is performed after a predetermined time ($\tau$1) from the rise of the plate detected signal (FIG. 9B).

Figure 5:
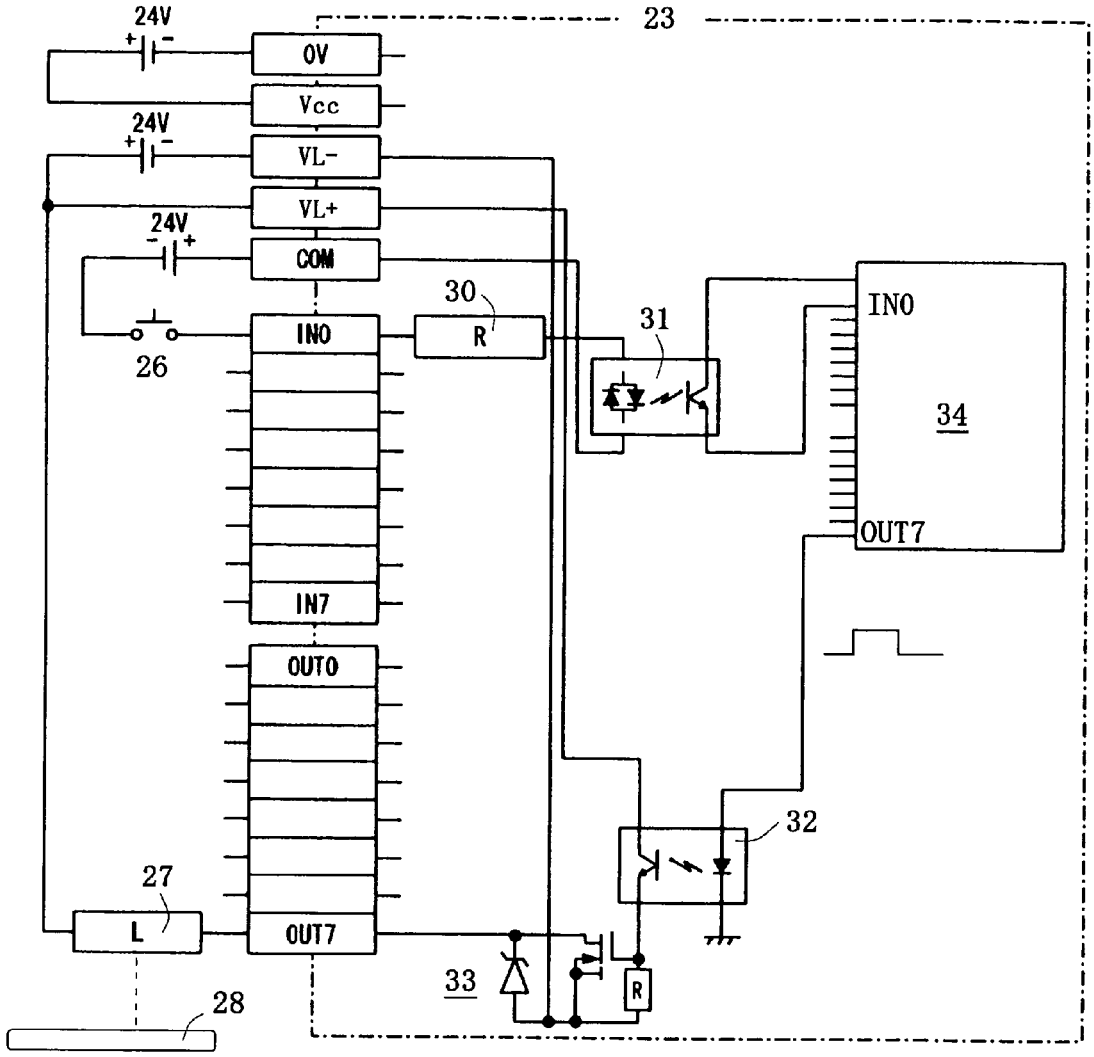
FIG. 5 is a block diagram showing a configuration of a DIO module.

FIG. 5 is a circuit block diagram of the DIO module 23. As shown in the figure, the DIO module 23 includes a current restricting resistor 30, a first photocoupler 31, a second photocoupler 32, a current output circuit 33 and an internal control circuit 34 having a serial communicating function. The internal control circuit 34 realizes a bidirectional serial communication with the management main body 22, but must communicate with the management main body 22 with its own terminal number added. Therefore, the management main body 22 performs a bidirectional communication with a plurality of DIO modules distinguished by the terminal number (see FIG. 10).

The DIO module 23 further comprises a first power supply terminal Vcc for receiving the power supply voltage, a second power supply terminal VL for receiving a direct current voltage for coil drive, a third power supply terminal COM for receiving a direct current voltage for switch drive, eight input terminals IN0 to IN7, and eight output terminals OUT0 to OUT7. A photoelectric switch 26 is connected to the input terminal IN0, and an electromagnetic coil 27 for driving the discharge rod 28 is connected to the output terminal OUT7. It is to be noted that the other input terminals IN1 to IN7 and the output terminals OUT0 to OUT6 are not used.

The photoelectric switch 26, more specifically, includes a light emitting element for emitting examining light and a light receiving element for receiving the examining light. The light emitting element and the light receiving element are arranged orthogonal to the transport path 2, and thus the examining light emitted from the light emitting element is blocked by the cylindrical base 12A (in particular, front end TOP) of the traveling plate, thereby turning ON the photoelectric switch 26. Herein, the separation distance LS (FIG. 9A) between the photoelectric switch 26 and the camera 20 is set so as to be shorter than the diameter $\Phi$ of the plate ($LS<\Phi$), and thus the photoelectric switch 26 is always turned ON before the camera 20 captures the two-dimensional code of the next plate. If, on the other hand, $LS>\Phi$, the first plate may not be discharged when the plate to be discharged continues.

When the photoelectric switch 26 is turned ON, the detection current flows in the route of third power supply terminal COM→first photocoupler 31→current restricting resistor 30. Thus, the switch ON signal of L level is input to the input port IN0 of the internal control circuit 34. In the internal control circuit 34, its terminal number is added to the switch ON signal and transmitted to the management main body 22.

The internal control circuit 34, on the other hand, outputs a pulse-shaped coil control signal from the output port OUT7 based on the command received from the management main body 22. The coil control signal passes through the second photocoupler 32 and the current output circuit 33 and is output from the output terminal OUT7 thereby driving the electromagnetic coil 27. As the coil control signal is pulse-shaped, the discharge rod 28 pushes the plate 12 out from the transport path 2 due to electrical conduction of the electromagnetic coil 27, which discharge rod 28 returns to the original position when the current of the electromagnetic coil 27 is stopped. The pulse width $\tau$2 of the coil control signal (FIG. 9B) is set to $\tau 2<\Phi/2<V$ in accordance with the moving velocity V of the endless chain 3 and the diameter $\Phi$ of the plate. Therefore, the reciprocating movement of the T-shaped discharge rod 28 has no influence on the plate on the upstream side of the plates to be discharged.

Figure 6:
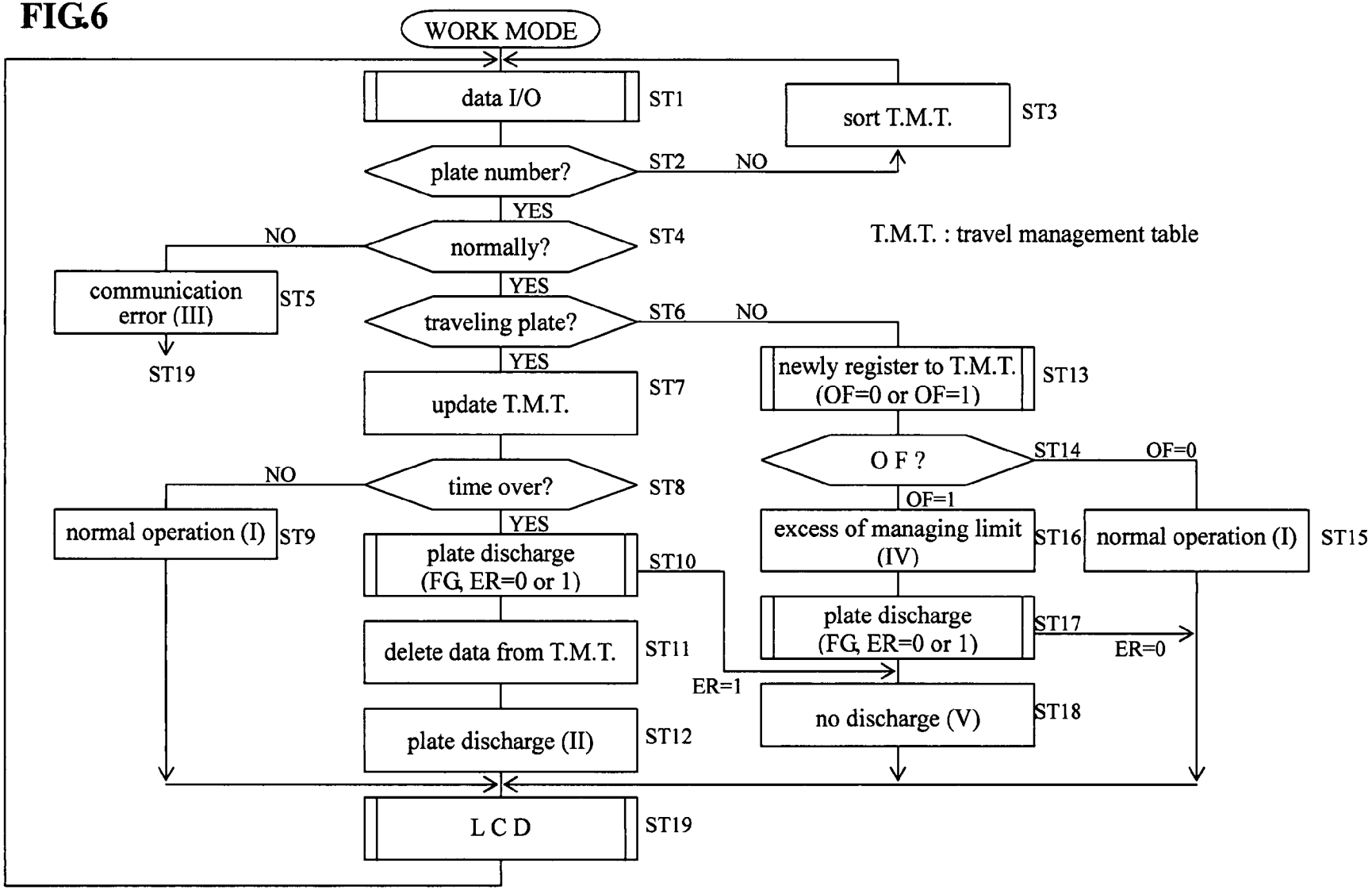
FIG. 6 is a flowchart explaining the operation of a management main body.

FIG. 6 is a flowchart showing the operation content of the management main body 22, and FIG. 7 shows a part of FIG. 6 in detail. The management main body 22 recognizes the traveling plate 12 and generates the management information based on the input signal from the barcode scanner 21, and if necessary, operates the discharge rod 28 through the DIO module 23. The operation of the management main body 22 will now be explained based on the flowchart of FIG. 6.

The management main body 22 repeats the data input/output process (ST1) with the DIO module 23 and waits for the barcode scanner 21 to output the plate number (ST2). It is to be noted that the data input/output process (ST1) is repeated until the management main body 22 receives the plate number, but the specific content thereof will be hereinafter described.

The plate with food and drink arranged thereon is continuously transported on the transport path 2, and the barcode of the moving plate is continuously captured by the camera 20. The barcode scanner 21 continuously analyzes the image data received from the camera 20, and when detecting the plate number, immediately transmits the extracted plate number to the management main body 22. Therefore, when the plate passes before the camera 20, the plate number thereof is immediately transmitted to the management main body 22 (ST2).

In the management main body 22 that has acquired the plate number, the presence of communication abnormality is determined through parity check (ST4). If communication abnormality is detected, "screen (III) indicative of communication error" is generated, the operation proceeds to the process of step 19 (ST5). If communication abnormality is not detected, the travel management table TBL1 (FIG. 8A) is searched for using the plate number as the retrieval key and determination is made whether or not the relevant plate number is already registered (ST6).

If the relevant plate number is detected from the travel management table TBL1, the content of the travel management table TBL1 is updated (ST7). More specifically, the present time is stored in the discrimination time column CL3, and the elapsed time from the charged time up to the present is stored in the elapsed time column CL4. Next, determination is made whether the elapsed time stored in the elapsed time column CL4 exceeds the upper limit time defining the expiration date (ST8), and if not exceeded, "screen (I) indicative of normal operation" is generated, and the operation proceeds to step ST19 (ST9). If the elapsed time exceeds the upper limit time, the plate discharge process is performed (ST10).

Figure 7A:
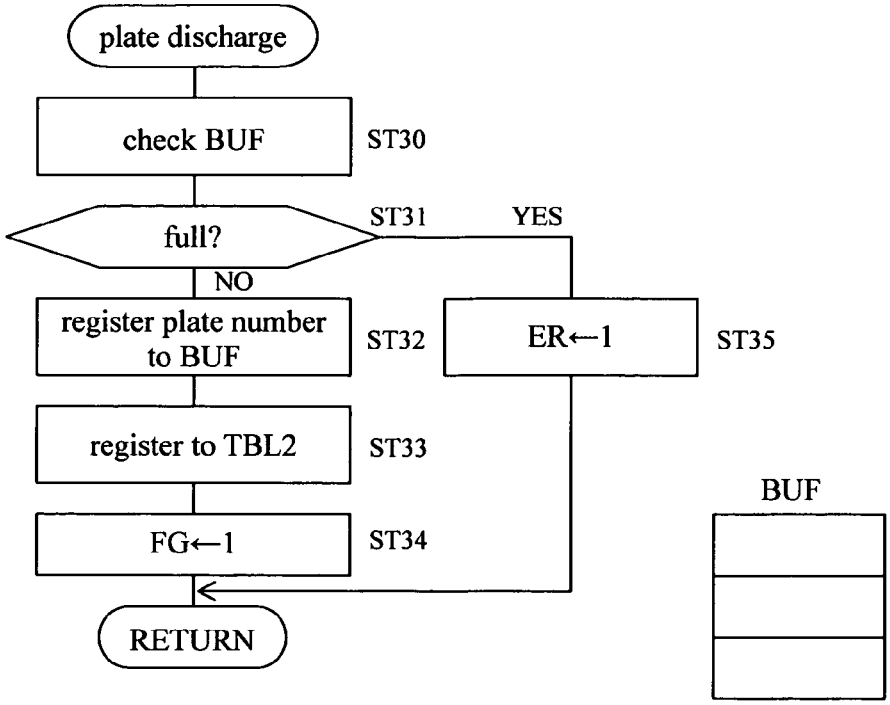
FIG. 7A is a flowchart explaining a plate discharge process.

FIG. 7A is a flowchart showing a specific content of the plate discharge process (ST10). In the plate discharge process, determination is first made whether a plate discharge buffer BUF is full or not (ST30). As shown in FIG. 9A, in the present embodiment, the distance LN from the camera 20 to the discharge rod 28 is set to be approximately twice the diameter Φ of the plate. Thus, three storage areas are reserved in the plate discharge buffer BUF to store three plate numbers (FIG. 9C).

If the plate discharge process starts (ST10, ST17) regardless of the fact that the plate discharge buffer BUF is full from the relationship of $L \approx 3\Phi$, it is considered to be due to an abnormal operation of the apparatus. Thus, in the process of step ST30, if determined that the plate discharge buffer BUF is full (ST31), the error flag ER is set to 1 and the process is terminated (ST35).

On the other hand, if a vacant area is left in the plate discharge buffer BUF, the plate number is stored in the vacant area (ST32). In this case, as shown in FIG. 9C, the plate number that has been already stored is shifted to the lower storage area and the relevant plate number is stored in the upper most area. The management main body 22 then stores the plate number, the charged time, the plate discharged time, the elapsed time, and the status to the storage columns CL5 to CL9 of the plate discharge table TBL2 (FIG. 8B) (ST33). It is to be noted that the stored content of the travel management table TBL1 is memory transferred for the plate charged time. Finally, the discharge flag FG is set to 1 and the subroutine of FIG. 7A is completed (ST34).

In such a way, of the plates passing before the camera 20, the outdated plate is registered in the plate discharge table TBL2 through the process of step ST33. However, the plate newly registered in the plate discharge table TBL2 is moving towards the photoelectric switch 26 from the camera 20 at this point, and in practice, is not discharged from the transport path 2. The relevant plate is, in practice, discharged from the transport path 2 by the data input/output process (ST1) subsequently performed.

When the plate discharge process (ST10 of FIG. 6) by the process of steps ST30 to ST34 is completed, the value of the error flag ER is then determined. If ER=1, the operation proceeds to step ST18, and "screen (V) indicating that no plate is discharged" is generated. If the error flag ER is not 1, the data of the plate to be discharged from the transport path 2 is deleted from the travel management table TBL1 (ST11). More specifically, the relevant data (plate number, charged time, discrimination time, and elapsed time of the plate to be discharged from the transport path 2) of the travel management table TBL1 are all replaced with invalid data (NULL). Of the travel management table TBL1, the row where the invalid data is stored is completely deleted in the process of step ST3 (consequently, the relevant row is cleared).

Next, the management main body 22 generates "screen (II) indicating that the plate is to be discharged due to pass of expiration date", and the operation proceeds to step ST19 (ST12). The generated screen is displayed on the liquid crystal display LCD of the management main body 22 by the process of step 19.

A case in which the determination of step ST6 is YES has been explained. A case in which the determination of step ST6 is NO will now explain be explained. If the determination of step ST6 is NO, the plate number extracted by the barcode scanner 21 is not present in the travel management table TBL1. In other words, the relevant plate is newly charged from the charging work section 9 to the transport path 2.

In this case, the operation proceeds to step ST13 to register the necessary information to the travel management table TBL1. As explained above, the manageable upper limit is defined for the travel management table TBL1. Therefore, in step ST13, determination is first made as to whether new registration is possible or not. If not possible, an overflow flag OF is set to 1 and the process is terminated (ST13). If not exceeding the upper limit, the new plate number is stored in the travel management table TBL1, and the present time is stored in the registration columns of the plate charged time as well as the plate discrimination time (ST13). Further, 0 is stored in the registration column of the elapsed time.

The value of the overflow flag OF is then determined (ST14). If the overflow flag OF=0, the registration to the travel management table TBL1 is properly completed, and "screen (I) indicative of normal operation" is generated. The operation then proceeds to step ST19 (ST15). If the overflow flag OF=1, "screen (IV) indicative of excess of upper limit of the travel management table" is generated, and the operation proceeds to the plate discharge process (ST17).

The plate discharge process (ST17) is as previously explained with reference to FIG. 7A. That is, in the plate discharge process (ST30 to ST35), if the plate discharge buffer BUF is not full, the plate number, the charged time, the plate discharged time, the elapsed time and the status are registered in the storage columns CL5 to CL9 of the plate discharge table TBL2. The data registered in this case are data relating to the newly charged plate. Since the plate which exceeds the upper limit is charged to the transport path 2, the newly charged plate is immediately discharged.

As noted above, in the processes of steps ST4 to ST19 of FIG. 6, access to either the travel management table TBL1 or the plate discharge table TBL2 is made, and does not actually include the process of discharging the plate. The process of actually discharging the plate is the data input/output process (ST1), and the detail thereof is as shown in FIG. 7B.

In the data input/output process, determination is first made whether or not the management main body 22 has received the plate detection signal from the DIO module 23 (ST40). The plate detection signal is a signal indicating that the photoelectric switch 26 has changed to the ON-state. The DIO module 23 transmits the plate detection signal, indicating that the photoelectric switch 26 has changed to the ON-state, to the management main body 22 with its own terminal number. The management main body 22 that receives the plate detection signal first determines whether the discharge flag FG is set to 1 or not (ST41).

The discharge flag FG is set to 1 only when the management main body 22 has detected the plate to be discharged (ST34). Therefore, if FG=0, no process is performed and the process proceeds to the process of step ST44. If FG=1, the discharge flag FG is reset to 0 (ST42), and timing operation of the timer TMR of hardware configuration is started (ST43).

Figure 7B:
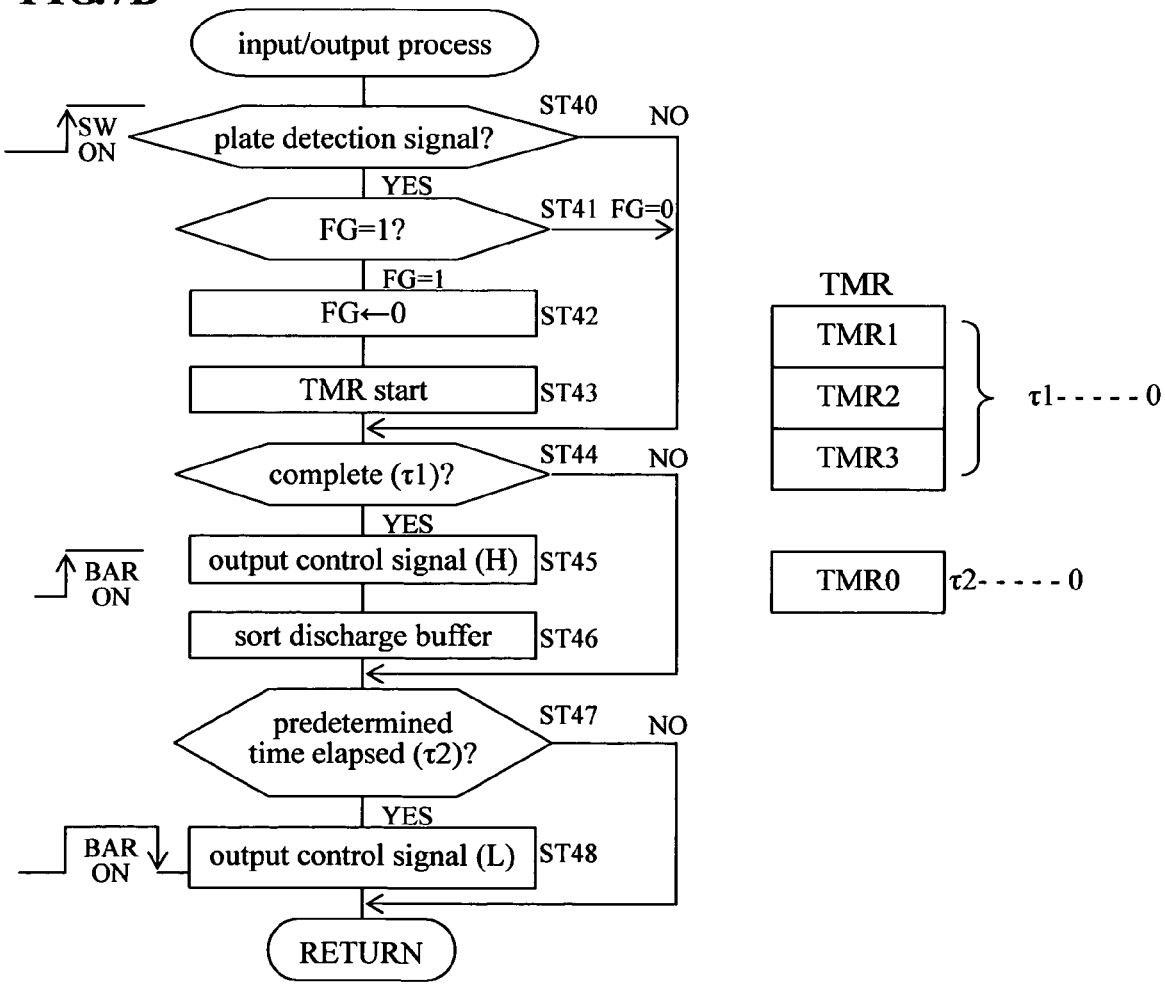
FIG. 7B is a flowchart explaining an input/output process.

The timer TMR times the delay time $\tau 1$, and three timers, TMR1 to TMR3, are prepared for three storage areas (see FIG. 9C) of the discharge buffer BUF (FIG. 7B). Therefore, in step ST43, the timing operation is started for one of the timer TMR that is in the non-operating state at the time. The delay time $\tau 1$ is the time required for the plate to move from the photoelectric switch 26 to the position of the discharge rod 28 (FIG. 9A). Therefore, the relationship between the distance DS (m) from the photoelectric switch 26 to the discharge rod 28 and the moving velocity V (m/s) of the endless chain 3 satisfies the equation $\tau 1=DS/V+\delta$. Herein, $\delta$ is a spare time corresponding to the radius $\Phi'/2$ of the cylindrical base 12A ($\delta=\Phi'/2/V$).

Next, in step ST44, determination is made whether the timer TMR1 to TMR3 that has finished the timing process exists or not (ST44). If the timer that has finished the timing process of delay time $\tau 1$ exists, the coil control signal of H level is output to the DIO module 23 (ST45). Of the three areas of the discharge buffer BUF, the data in the lower most area in use is deleted (ST46). More specifically, NULL data is written to the relevant area.

The coil control signal output in the process of ST45 is a signal for electrically conducting the electromagnetic coil 27, and is returned to L level after a predetermine time $\tau 2$ (ST48). Therefore, the pulse width of the control signal transmitted to the electromagnetic coil 27 is $\tau 2$ but such pulse width is managed by a timer TMR0.

FIG. 9 is a view explaining the plate discharge process. As shown in the figure, although the plate 1 to plate 3 are traveling on the transport path 2 in this example, all the plates are assumed to have past the expiration date. At timing t2 shown in FIG. 9B, the management main body 22 that has recognized the plate number of plate 1 stores the plate number of plate 1 to the plate discharge buffer BUF (ST32). Thereafter, when the management main body 22 recognizes the ON-operation of the photoelectric switch 26 at timing t3, the operation of the timer TMR1 is started (ST43). As explained above, due to the relationship of $LW<\Phi$, the photoelectric switch 26 performs the ON-operation before the plate number of the next plate is extracted.

Therefore, the management main body 22 recognizes the plate number of plate 2 at timing t2' later than timing t3, and stores the plate number of plate 2 to the plate discharge buffer BUF (ST32). At this point, the plate number of plate 1 is shifted and the plate number of plate 2 is stored in the top storage area. Further, the management main body 22, when recognizing the ON-operation of the photoelectric switch 26 at timing t3', starts the operation of the timer TMR2 (ST43).

Further, the management main body 22 recognizes the plate number of plate 3 at timing t2", and stores the plate number of plate 3 in the plate discharge buffer BUF (ST32). At this point, the plate numbers of plate 1 and plate 2 are shifted in a sequential order and the plate number of plate 3 is stored in the top storage area. Further, the management main body 22, when recognizing the ON-operation of the photoelectric switch 26 at timing t3", starts the operation of the timer TMR3 (ST43).

Thereafter, at timing t4, the timing operation of the timer TMR1 is completed, and the management main body 22 outputs the coil control signal (ST45) and also deletes the plate number of plate 1 from the plate discharge buffer BUF (ST46). The same goes for the other plate numbers. As the timing operation of timer TMR2 is completed at timing t4', the management main body 22 outputs the coil control signal (ST45) and also deletes the plate number of plate 2 from the plate discharge buffer BUF (ST46). Further, as the timing operation of timer TMR3 is completed at timing t4", the management main body 22 outputs the coil control signal (ST45) and also deletes the plate number of plate 3 from the plate discharge buffer BUF (ST46).

As note above, the actual plate discharge process is performed in the data input/output process (ST1) based on the plate discharge flag FG set in the plate discharge process (ST10). Further, the information (i.e., management information of plate) of the discharged plate is accumulated in the discharge table TBL2. The management information accumulated in the discharge table TBL2 is thus collected in the personal computer 24 once a day, for example. When calling out the management information, the communication program such as, "Hyper Terminal" is activated in the personal computer 24, and through the command setting of the communication program, sets the CSV data output from the management main body 22 to be saved under an appropriate file name. Subsequently, the received management information is stored in the personal computer 24 by operating the touch panel of the management main body 22. The management information may be printed any time when necessary by means of the printer 25.

In this apparatus, since the information of the outdated plate is printed and output, if the plate number and the food and drink arranged on such plate are associated in advance, the unpopular food and drink may be reliably known. Different expiration date may be set for each plate. In order to associate the plate number and the food and drink arranged on such plate, the color of the plate is expressed in a part of the plate number and the same food and drink is arranged on the plate of the same color. For example, the red plate may all have a plate number of "1XXXX" and may always be arranged with "tuna". Further, the blue plate may all have a plate number of "2XXXX", and may always be arranged with "shrimp".

In FIG. 4, there is explained a configuration in which only one barcode scanner 21 and one DIO module 23 are used. However, as the communication between the DIO module 23 and the management main body 22 is performed with the terminal number of the DIO module specified, the number of DIO modules may be suitably increased.

Figure 10:
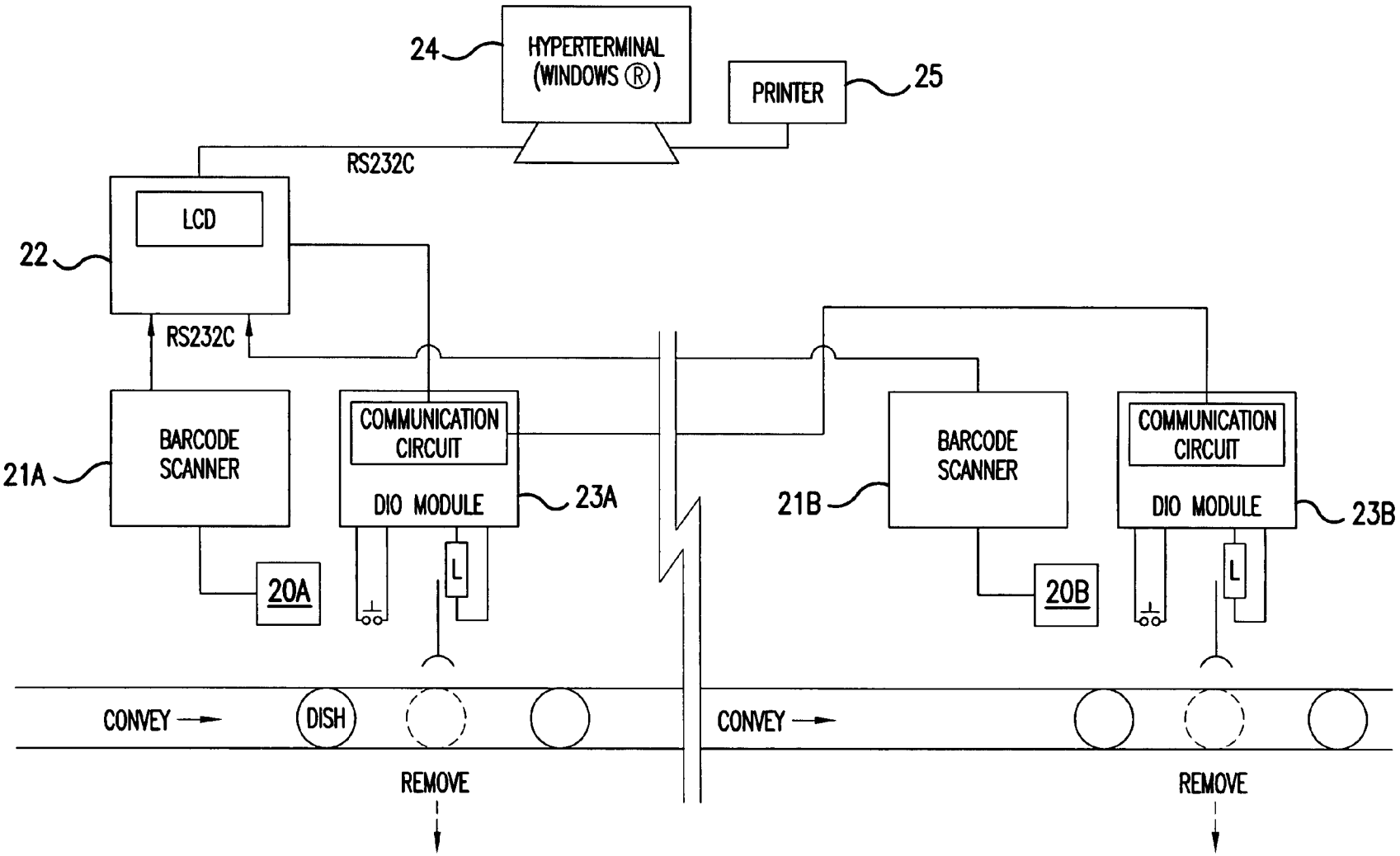
FIG. 10 is a block diagram showing another configuration of the management device.

The circulating type transport apparatus 1 of FIG. 10 includes two sets of barcode scanner 21 and DIO module 23, and in this case, the expiration data can be more accurately managed. That is, in the apparatus of FIG. 4, the discharge process of the plate is not performed until one round of the transport path 2 is completed, but in the apparatus of FIG. 10, the discharge process can be performed earlier.

What is claimed is:

1. A circulating type transport apparatus comprising:

an endless chain slidably moving on a circulating type transport path;

a drive section for circulating the endless chain; and a management device for managing an expiration date of food and drink arranged on plate traveling on the endless chain, the management device including:

a camera for capturing a two-dimensional code on a cylindrical base of the plate;

a barcode scanner for analyzing the two-dimensional code captured by the camera and extracting a plate number;

a management main body for receiving the plate number output from the barcode scanner and collectively managing the travel plates; and a DIO (Digital Input/Output) module, connected to a detection switch disposed on a downstream position of the camera and a discharge mechanism disposed on a downstream side of the detection switch, for performing bidirectional communication with the management main body, a separation distance between the camera and the detection switch being set to be shorter than a diameter Φ of the plate, and the DIO module having:

notification means for transmitting a detection signal received from the detection switch to the management main body; and discharge means for operating the discharge mechanism based on a control signal received from the management main body, wherein the management main body includes:

a travel management table TBL1 for managing an elapsed time from a start of travel for all the plates traveling on the circulating type transport path in relation to the plate number;

a discharge table TBL2 for managing a discharge process time for the plates which elapsed time has exceed a predetermined value in relation to the plate number;

a discharge flag FG for temporarily storing the fact that the plate which elapsed time has exceeded the predetermined value is detected; and a timer TMR for timing a time from when receiving the detection signal from the DIO module until operating the discharge mechanism.

* * * * *